United States Patent [19]

Sylvester

[11] Patent Number: 4,512,464

[45] Date of Patent: Apr. 23, 1985

[54] METHOD OF FOLDING T-SHIRTS AND FOLDED SHIRT ARRANGEMENT RESULTING THEREFROM

[75] Inventor: John D. Sylvester, Garden City, N.Y.

[73] Assignee: Amscomatic, Inc., Long Island City, N.Y.

[21] Appl. No.: 637,646

[22] Filed: Aug. 3, 1984

[51] Int. Cl.[3] ..... B65D 85/18

[52] U.S. Cl. ..... 206/292; 206/278; 53/429

[58] Field of Search ..... 206/282, 283, 286, 287, 206/287.1, 292, 278; 53/429, 117

[56] References Cited

U.S. PATENT DOCUMENTS

| | | | |
|---|---|---|---|
| 2,324,722 | 7/1943 | Papierniak | 206/278 |
| 3,359,569 | 12/1967 | Rotanz et al. | 206/278 |
| 3,688,948 | 9/1972 | Roda | 206/292 |
| 3,908,823 | 9/1975 | Smith | 206/292 |
| 4,132,309 | 1/1979 | Shaylor | 206/278 |
| 4,285,427 | 8/1981 | Webinger | 206/292 |

*Primary Examiner*—Joseph Man-Fu Moy
*Attorney, Agent, or Firm*—Alan H. Levine

[57] ABSTRACT

A method of folding at least two T-shirts involving laying out two or more shirts in flat condition with the front of a first of the shirts facing the other shirt, and folding the top part of the first shirt backwardly upon itself. A stiffener board is placed against the exposed face of the shirt farthest from the first shirt, and the bottom and sides of all the shirts are folded over the stiffener board. Thereafter, the top of each shirt, except the first shirt, is folded over the stiffener. The folded shirts may be inserted as a unit into a container.

12 Claims, 17 Drawing Figures

FIG. 5
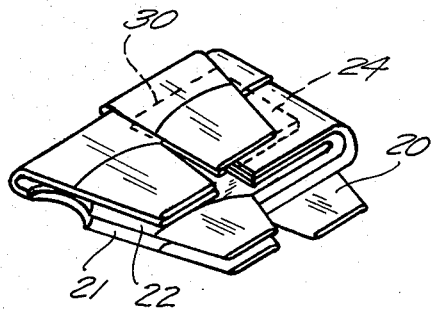
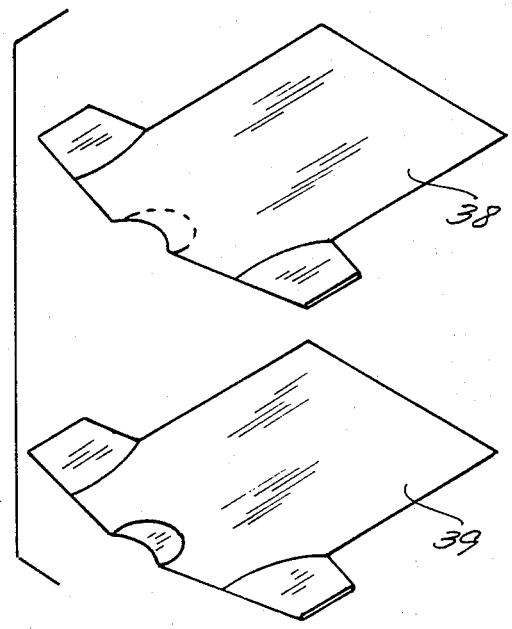
FIG. 9
FIG. 6
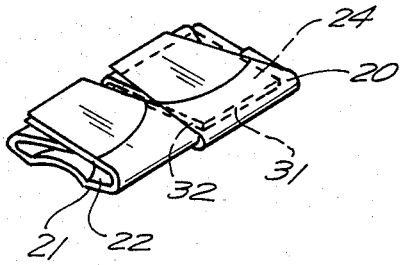
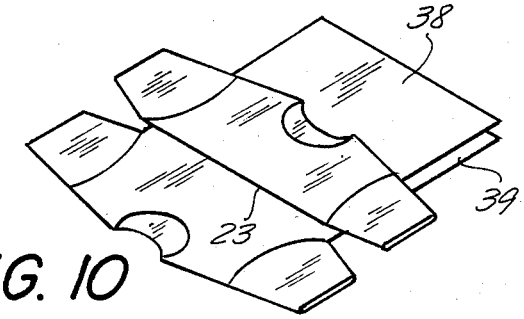
FIG. 10
FIG. 7
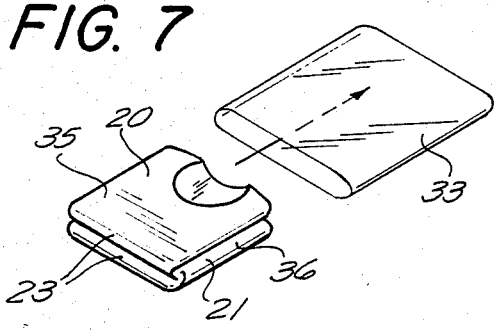
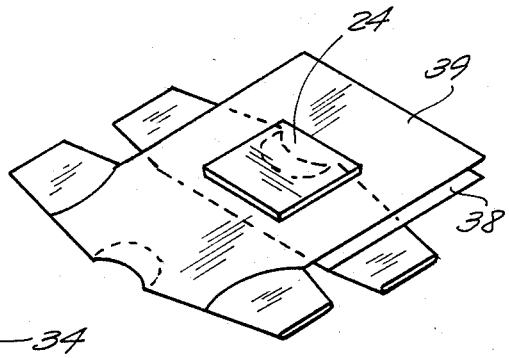
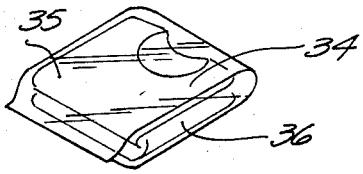
FIG. 8
FIG. 11

METHOD OF FOLDING T-SHIRTS AND FOLDED SHIRT ARRANGEMENT RESULTING THEREFROM

This invention relates to folding of garments, and more particularly to a method of folding a plurality of T-shirts to create a single article of merchandise. Coordinately, the invention relates to a folded T-shirt arrangement resulting from the method.

It is common practice for manufacturers of T-shirts to merchandise them in units of two or three shirts, often packaging two or three shirts in a single container, the container usually being a plastic bag. In the past, each of the T-shirts was folded individually, one or two of them being folded over a rectangular stiffener board, such as a sheet of cardboard. The shirts were then inserted into a plastic bag and the bag sealed.

More recently, to save on labor and cardboard costs, many manufacturers laid unfolded shirts out flat, one on top of the other in registry, and folded them simultaneously over a single stiffener board. The folded-together shirts were then inserted into a bag. In many cases, the placement of the stiffener, folding of the shirts, and insertion into the bag have been done by machine.

A problem presented by the shirt-packaging method just described is that the bulk formed by the folded-over sleeves of the three shirts is all located in one place, namely, near the folded edge of the package opposite the shirt collars. This problem was solved by the method illustrated and described in U.S. Pat. No. 3,886,712. While the method of that patent was successful in dealing with the bulk problem to which it was directed, a package resulting from that method presents problems of its own. The folded-together shirts of that package include a front portion and a rear portion joined by the final fold line located at the bottom of the folded-together shirts, and the stiffener board is located within the rear portion of the folded-together shirts. As a result, it is difficult to maintain the exposed front portion of the shirts taut, since there is no stiffener board in the front portion. Furthermore, when the shirt package is stood on end, i.e., on the fold line at the bottom of the folded-together shirts, the exposed front shirt tends to slip down within the package and become rumpled. Consequently, the package is not as sightly as might be desired.

It is an object of the present invention to overcome these problems by providing a T-shirt folding method involving a special way of arranging and folding shirts so that the stiffener board is located in the front portion of the folded-together shirts. As a result, the front of the shirt exposed at the front of the folded shirt arrangement can be pulled taut around the stiffener board, and the stiffener board supports that shirt against falling when the shirts are packaged in a container and the package is stood on end.

It is to be understood that the present T-shirt folding method has utility even if the folded shirt arrangement is not inserted into a container. The shirts can be held in folded condition by means such as pins or a band around the shirts, and merchandised in unpackaged condition.

It is another object of the invention to provide such a T-shirt folding method wherein, if desired, the front of a T-shirt is exposed on each side of the package.

It is an additional object of the invention to provide such a folding method which can be employed with T-shirt folding and packaging machines, or which alternatively can readily be practiced manually.

It is a further object of the invention to provide an arrangement of folded T-shirts resulting from this folding method.

Additional objects and features of the invention will be apparent from the following description in which reference is made to the accompanying drawings.

In the drawings:

FIGS. 3–7 are perspective views of the three T-shirts showing a sequence of further steps according to the present folding method;

FIG. 8 is a perspective view of the finished package;

FIG. 9 is an explosed perspective view of two T-shirts;

FIGS. 10–16 are perspective views of the two T-shirts of FIG. 9 showing an alternative sequence of steps according to the present folding method.

Figure 1:
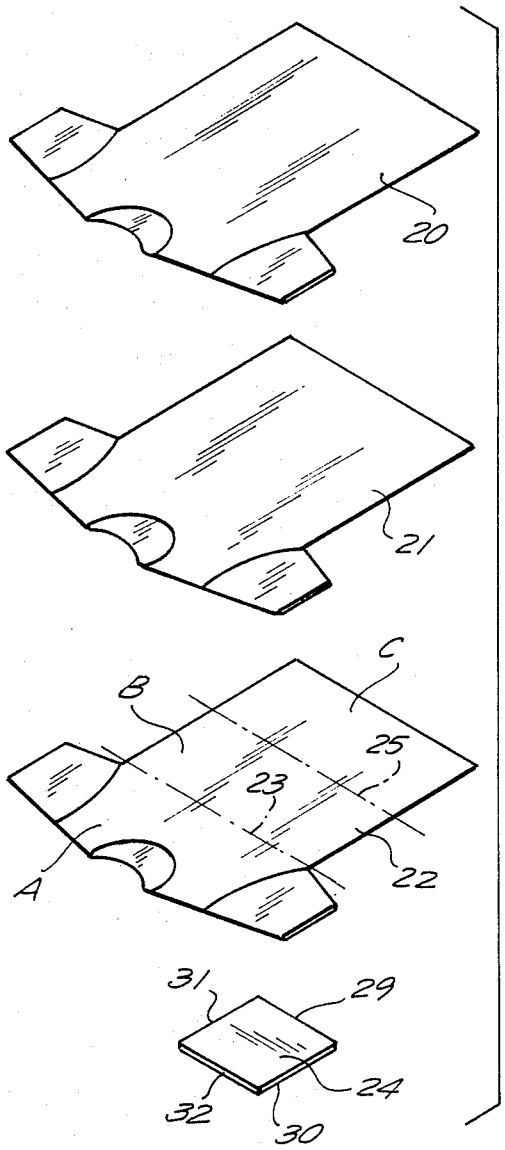
FIG. 1 is an exploded perspective view of three T-shirts and a stiffener board.
Figure 3:
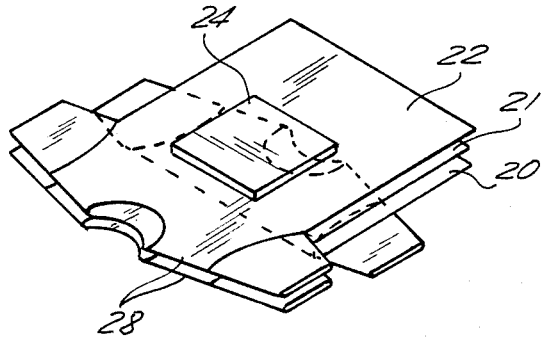

A folding method chosen to illustrate the present invention will be described with reference to FIGS. 1–8. The three T-shirts to be folded bear the reference numerals 20, 21, and 22. The shirts themselves are entirely conventional. Each shirt may be thought of as divided by transverse imaginary lines 23 and 25 into a top part A, a central part B, and a bottom part C, as indicated on shirt 22 of FIG. 1. This same figure also shows a stiffener board 24, preferably of cardboard.

Figure 2:
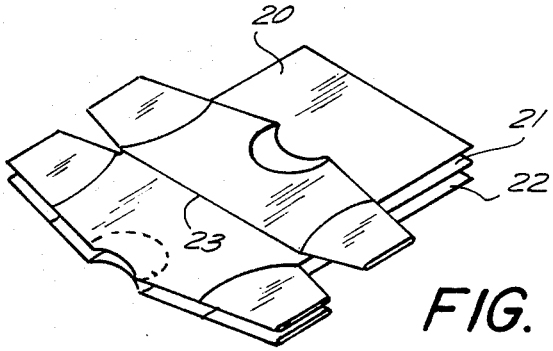
FIG. 2 is a perspective view of the three T-shirts in superposed relation with the top part of a first of the shirts folded upon itself.

Initially, the three shirts are arranged in flat, superposed relation with the fronts of all the shirts facing in the same direction, as indicated in FIG. 1. In FIG. 2, the shirts are lying front-down, and the top of shirt 20 is folded backwardly upon itself generally along line 23. Although the front of the top part of shirt 20 originally faced toward shirt 21, it now faces outwardly, i.e., away from shirt 21. This is important, since it is the top part of shirt 20 which will be seen through the transparent plastic bag of the final package.

If the shirts are to be folded and packaged by a conventional shirt folding and packaging machine, they would be fed to the machine in the orientation shown in FIG. 2, since the machine provides stiffener boards to the shirts from beneath. However, if the shirts are to be folded by hand, the arrangement of FIG. 2, is flipped over, i.e., rotated 180° about the longitudinal axes of the shirts, to the orientation shown in FIG. 3. It is also more convenient to explain the following steps of the method using the orientation of FIG. 3.

The next step involves placing a stiffener board 24 upon shirt 22, which is now on top of shirts 20 and 21. The size of stiffener board 24 may be a standard one which is related to the size of the plastic bag in which the shirts are to be packaged. Although a rectangular stiffener board is illustrated, the stiffener could have any desired shape. Stiffener board 24 is centered with respect to the sides of the shirts, and is spaced from the top edges 28 of shirts 21 and 22 a distance about equal to the length of the stiffener board.

Figure 4:
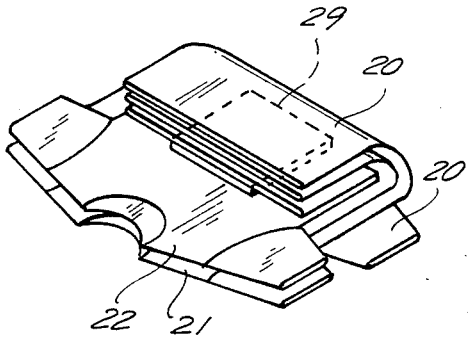

As shown in FIG. 4, the bottom parts of all three shirts are folded around the bottom edge 29 of stiffener board 24. One side portion of each shirt and the sleeve on that side are then folded over a side edge 30 of a stiffener 24, as shown in FIG. 5. Then, the other side portion and sleeve of each shirt are folded over the other side edge 31 of stiffener 24, as shown in FIG. 6. Although the bottom parts C of the shirts have been shown and described as being folded over the stiffener board first followed by the side portions, the side portions and sleeves could be folded over the stiffener first followed by the bottom parts.

The final folding step involves folding the top parts A of shirts 21 and 22 along fold lines 23 over the top edge 32 of stiffener board 24, as shown in FIG. 7. The three folded-together shirts may then be inserted into a container 33, usually a clear plastic bag, which is then sealed, such as by a conventional heat seal, to form a finished package 34 (FIG. 8). Alternatively, the folded-together shirts may be pinned together or encircled by a paper band, and merchandised without a container.

It will be appreciated that the top part A of shirt 20, and the side portions of that top part are wrapped around stiffener board 24. In this way, the top part of shirt 20 can be pulled taut around the stiffener board. In other words, stiffener boar 24 is located within the upper folded section 35 (FIGS. 7 and 8) and not in the lower folded section 36. Consequently, when package 34 is stood on end, stiffener board 24, being within the upper folded section 35, close to the top part of shirt 20, prevents that shirt from sliding down within the package and becoming rumpled.

An alternative shirt folding arrangement according to the invention is illustrated in FIGS. 9–17. In this case, two T-shirts 38 and 39 to be folded are arranged in superposed relation with their fronts facing each other, as indicated in FIG. 9. The top portion A of shirt 38 is folded backwardly upon itself along line 23, as shown in FIG. 10. The arrangement of FIG. 10 is flipped over, i.e., rotated 180° about the longitudinal axes of the shirts, to the orientation shown in FIG. 11, and a stiffener board 24 is placed upon the central portion B of shirt 39.

Figure 12:
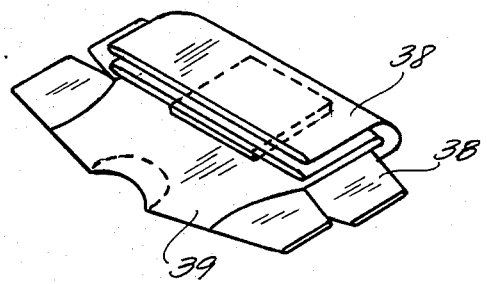
Figure 13:
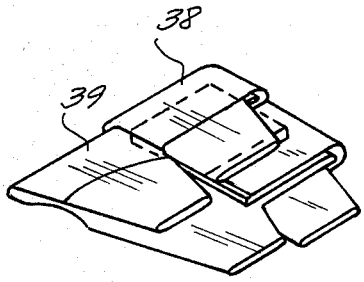
Figure 16:
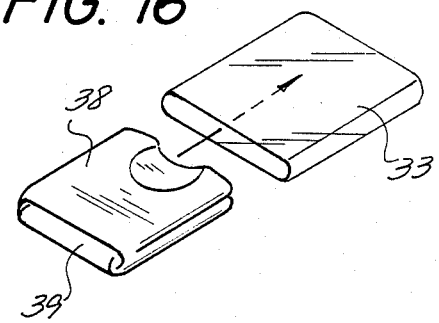
Figure 14:
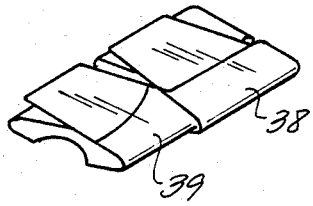
Figure 17:
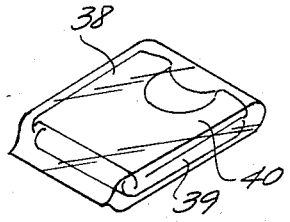
FIG. 17 is a perspective view of a finished package containing the folded T-shirts of FIGS. 9–16.

The bottom parts C of both shirts are then folded over the bottom edge of stiffener board 24, as shown in FIG. 12. Thereafter, one side portion of each shirt and the sleeve on that side are folded over one side edge of the stiffener board, as shown in FIG. 13, after which the other side portion and sleeve of each shirt are folded over the other side edge of stiffener board 24, as shown in FIG. 14. Finally, the top part of shirt 39 is folded over the top edge of stiffener board 24. The two folded-together shirts may then be inserted into a container 33, such as a clear plastic bag, which is then sealed to form the finished package 40 (FIG. 17). Alternatively, the folded-together shirts may be pinned or banded together, and sold without a container.

Figure 15:
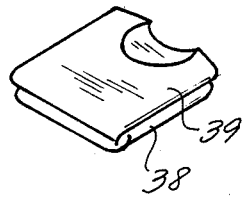

It will be appreciated that as a result of the folding method just described, the front of the top portion of shirt 38 is exposed on one side of package 40 (see FIGS. 16 and 17), and the front of the top portion of shirt 39 is exposed on the other side of the package (see FIG. 15). Furthermore, the top portion of shirt 38 is wrapped around stiffener board 24, so that this part of the exposed shirt remains taut even when the package 40 is stood on end.

It may be mentioned that if in the folding method described with respect to FIGS. 1–8, shirt 21 were flipped over so that initially its front were to face shirt 20, then the front of shirt 20 would be exposed on one side of package 34 and the front of shirt 21 would be exposed on the other side of package 34.

The invention has been shown and described in preferred form only, and by way of example, and many variations may be made in the invention which will still be comprised within its spirit. It is understood, therefore, that the invention is not limited to any specific form or embodiment except insofar as such limitation are included in the appended claims.

I claim:

1. A method of folding at least two T-shirts in a single container comprising the steps of:

(a) laying out a first and at least one other shirt superposed in flat condition and in registry, the front of the first shirt facing the shirt adjacent to it, (b) folding the top part ofthe first shirt backwardly upon itself along a line substantially parallel to the bottom of the shirt, (b) placing a stiffener board against the exposed face of the shirt farthest from the first shirt, in a location where the stiffener board is in registry with the central part of the top portion of the first shirt, (d) folding over the stiffener board the bottoms and the sides of all the shirts, and (e) then folding the top of each shirt, except the first shirt, over the stiffener board.

2. A method as defined in claim 1 including the step of inserting the folded shirts as a unit into a container.

3. A method as defined in claim 1 wherein when the shirts are laid out, the front of the shirt farthest from the first shirt faces the first shirt.

4. A method as defined in claim 1 wherein when the shirts are laid out, the back of the shirt farthest from the first shirt faces the first shirt, whereby after the folding step (e) the fronts of both said first and farthest shirts face outwardly of the folded shirts.

5. A method as defined in claim 1 wherein there are three T-shirts, and when the shirts are laid out, the fronts of both shirts other than the first shirt face the first shirt.

6. A method as defined in claim 1 wherein there are two T-shirts, and when the shirts are laid out, the back of the shirt other than the first shirt faces the first shirt.

7. An arrangement of folded T-shirts comprising:

(a) at least two shirts each having a top part, a central part, a bottom part, and two sides, (b) a first of the shirts being folded along two lines parallel to the shirt bottom so that its central part is between its top and bottom parts, (c) each of the other shirts being folded along two lines parallel to the bottom of that shirt, the bottom and central part of each other shirt being between the bottom and central part of the first shirt, (d) a stiffener board between the bottom and central part of the shirt farthest from the first shirt, and (e) the bottom parts and sides of all the shirts being folded between the top part of the first shirt and the top part of the shirt farthest from the first shirt.

8. An arrangement as defined in claim 7 including a container holding all the folded shirts.

9. An arrangement as defined in claim 7 wherein the front of the top part of the first shirt is exposed on one face of the folded shirts, and the back of the top part of the shirt farthest from the first shirt is exposed on the other face of the folded shirts.

10. An arrangement as defined in claim 9 wherein there are three shirts in the folded shirt arrangement.

11. An arrangement as defined in claim 7 wherein the front of the top part of the first shirt is exposed on one face of the folded shirts, and the front of the top part of the shirt farthest from the first shirt is exposed on the other face of the folded shirts.

12. An arrangement as defined in claim 11 wherein there are two shirts in the folded shirt arrangement.

* * * * *